US010829967B2

(12) United States Patent
Mott

(10) Patent No.: US 10,829,967 B2
(45) Date of Patent: Nov. 10, 2020

(54) BUS CONFIGURED LATCHING SOLENOID

(71) Applicant: BorgWarner Inc., Auburn Hills, MI (US)

(72) Inventor: Philip J. Mott, Dryden, NY (US)

(73) Assignee: BorgWarner Inc., Auburn Hills, MI (US)

( * ) Notice: Subject to any disclaimer, the term of this patent is extended or adjusted under 35 U.S.C. 154(b) by 891 days.

(21) Appl. No.: 15/507,543

(22) PCT Filed: Aug. 24, 2015

(86) PCT No.: PCT/US2015/046484
§ 371 (c)(1),
(2) Date: Feb. 28, 2017

(87) PCT Pub. No.: WO2016/036530
PCT Pub. Date: Mar. 10, 2016

(65) Prior Publication Data

US 2017/0247917 A1 Aug. 31, 2017

Related U.S. Application Data

(60) Provisional application No. 62/045,806, filed on Sep. 4, 2014.

(51) Int. Cl.

| | |
|---|---|
| ***E05B 81/56*** | (2014.01) |
| ***E05B 81/08*** | (2014.01) |
| ***H01F 7/121*** | (2006.01) |
| ***H01F 7/16*** | (2006.01) |
| ***E05B 77/48*** | (2014.01) |
| *H01H 47/04* | (2006.01) |
| *F01L 1/26* | (2006.01) |

(Continued)

(52) U.S. Cl.
CPC ..... *E05B 81/08* (2013.01); *E05B 77/48* (2013.01); *E05B 81/56* (2013.01); *H01F 7/121* (2013.01); *H01F 7/1607* (2013.01); *F01L 1/146* (2013.01); *F01L 1/267* (2013.01); *G09F 3/0305* (2013.01); *H01H 47/00* (2013.01); *H01H 47/04* (2013.01)

(58) Field of Classification Search
USPC ..... 361/139, 143, 149, 160, 166
See application file for complete search history.

(56) References Cited

U.S. PATENT DOCUMENTS

| | | | |
|---|---|---|---|
| 3,871,474 | A | 3/1975 | Tomlinson et al. |
| 5,044,678 | A | 9/1991 | Detweiler |

(Continued)

FOREIGN PATENT DOCUMENTS

| | | | |
|---|---|---|---|
| CN | 2321103 | Y | 5/1999 |
| JP | 07-0102844 | A | 4/1995 |

OTHER PUBLICATIONS

International Search Report dated Nov. 30, 2015.

*Primary Examiner* — Danny Nguyen
(74) *Attorney, Agent, or Firm* — Young Basile Hanlon & MacFarlane, P.C.

(57) ABSTRACT

A latching solenoid (100, 200, 300) includes a coil (114) and an armature (120). The armature (120) moves between latch position and a rest position in response to momentary energization of the coil (114) without moving in response to de-energization of the coil (114). A solenoid controller (140) is operable to receive messages from a vehicle bus (108, 410) and output control signals that cause energization of the coil (114).

20 Claims, 4 Drawing Sheets

(51) Int. Cl.

| | |
|---|---|
| *F01L 1/14* | (2006.01) |
| *H01H 47/00* | (2006.01) |
| *G09F 3/03* | (2006.01) |

(56) References Cited

U.S. PATENT DOCUMENTS

| | | | | |
|---|---|---|---|---|
| 5,197,003 | A | 3/1993 | Moncrief et al. | |
| 2006/0087782 | A1* | 4/2006 | Michalko | H02H 3/04 361/62 |
| 2009/0145674 | A1* | 6/2009 | Lee | B60K 6/405 180/65.1 |
| 2011/0215898 | A1 | 9/2011 | Ramos-Elizondo et al. | |

* cited by examiner

BUS CONFIGURED LATCHING SOLENOID

BACKGROUND

The term solenoid refers generally to a coil of wire that produces a magnetic field within the coil of wire when it is electrically energized. In the context of engineering applications, the term solenoid refers to a class of electromechanical transducers in which a coil of wire surrounds a movable core called an armature. As an example, the armature can be formed from iron. When the coil of wire is energized by applying an electrical current across the coil, the armature moves.

In automotive applications, solenoids are used in a variety of ways. As one example, power locking and unlocking systems for vehicle doors typically utilize solenoids to move the mechanical components of the locking mechanism between a locked position and an unlocked position. As another example, a solenoid is used in conjunction with the electric starter motor of a vehicle's internal combustion engine to cause power to be supplied to the electric starter motor and to cause the pinion of the electric starter motor to move into engagement with the flywheel of the engine. As another example, various solenoid-controlled valves are used in vehicles to control the flow of fluids, such as in fuel injectors. In all of these examples, actuation of the solenoid is often controlled by a central control unit that controls the operation of multiple solenoids as well as other vehicle systems. Because solenoids operate in response to supply of electrical power, the vehicle's wiring harness will include a dedicated conductor from the central control unit to each solenoid.

In some solenoid designs, the armature moves to the rest position when no power is applied to the coil of the solenoid, and moves to an activated position when electrical power is applied to the coil of the solenoid. Typically, the armature moves to the rest position under the influence of a spring. Such devices are referred to herein as non-latching solenoids. In order for a non-latching solenoid to remain in the activated position, electrical power must be continuously supplied to the non-latching solenoid. Other solenoid designs, referred to herein as latching solenoids, move between a rest position and a latched position in response to momentary supply of electricity to the latching solenoid.

A vehicle bus is a communications network that interconnects components inside a vehicle. Vehicles commonly have multiple vehicle buses that service different groups of components or areas of the vehicle. Vehicle buses include a physical medium, such as a single wire or a twisted pair wire, to which multiple devices in the vehicle are connected in parallel.

The devices transmit messages over the vehicle bus using a communications protocol. One example of a common protocol is the CAN bus protocol, as described in ISO 11898.

SUMMARY

One aspect of the disclosed embodiments is a latching solenoid that includes a coil and an armature. The armature moves between a latch position and a rest position in response to momentary energization of the coil without moving in response to de-energization of the coil. A solenoid controller is operable to receive messages from a vehicle bus and output control signals that cause energization of the coil of the latching solenoid.

Another aspect of the disclosed embodiments is a vehicle that includes a vehicle bus, a vehicle power supply that supplies electrical power to the vehicle bus, a central control unit connected to the vehicle bus for transmitting messages via the vehicle bus, and a plurality of separately addressable latching solenoids connected to the vehicle bus for receiving the messages from the central control unit. Each of the separately addressable latching solenoids includes a coil, an armature, wherein the armature moves between a latch position and a rest position in response to momentary energization of the coil without moving in response to de-energization of the coil, and a solenoid controller that is operable to output control signals that cause energization of the coil in response to the messages from the vehicle bus.

BRIEF DESCRIPTION OF THE DRAWINGS

The description herein makes reference to the accompanying drawings, wherein like referenced numerals refer to like parts throughout several views, and wherein.

DETAILED DESCRIPTION

The disclosure herein is directed to bus configured latching solenoids for automotive applications that receive control signals via the vehicle bus of a vehicle. By providing each solenoid with a solenoid controller that has a device identifier value and is operable to receive messages from the vehicle bus, multiple solenoids can be addressed and controlled individually via the vehicle bus.

Figure 1:
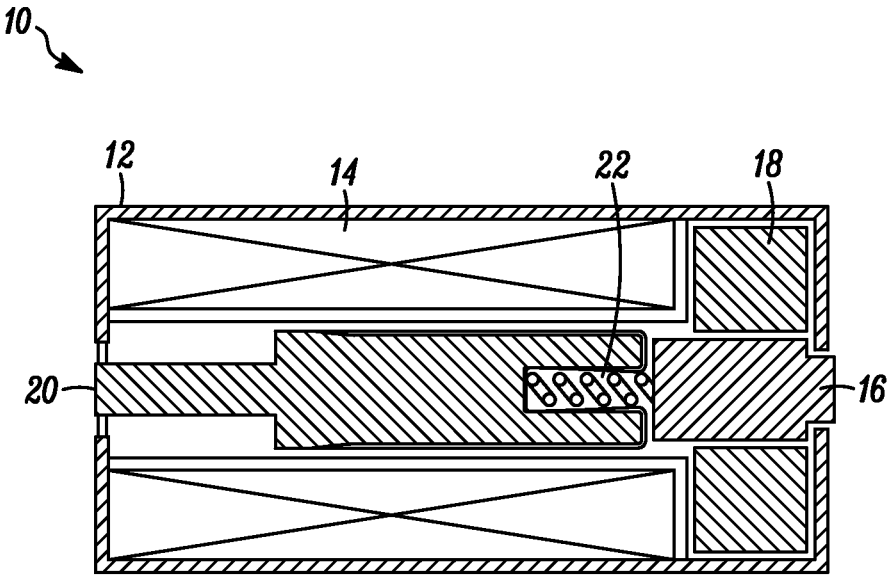
PRIOR ART FIG. 1
FIG. 1 is a side cross-section view of a prior art latching solenoid in a latched position.
Figure 2:
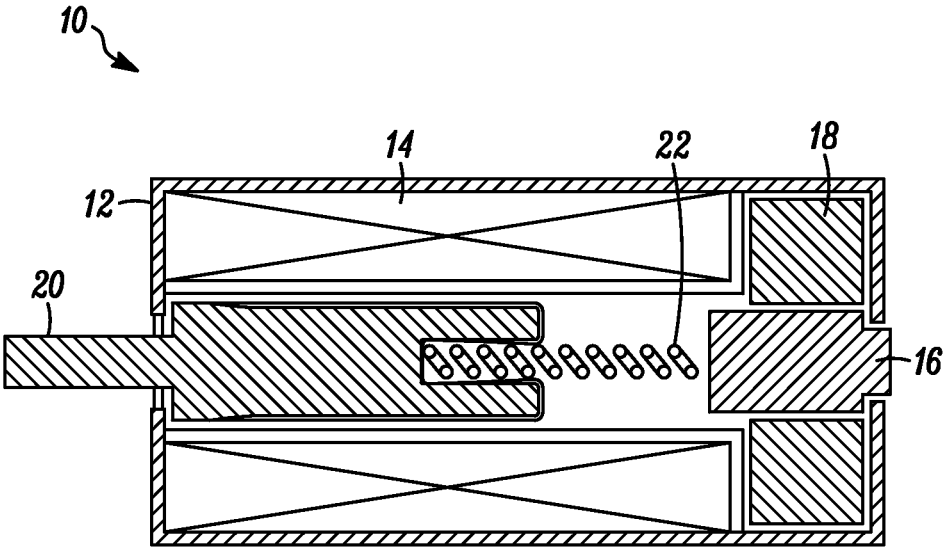
PRIOR ART FIG. 2
FIG. 2 a side cross-section view of the prior art latching solenoid in a rest position.

FIGS. 1-2 show a latching solenoid 10 of a conventional prior art design. The latching solenoid 10 is an electromechanical device that produces motion in response to supply of electrical power. The latching solenoid 10 includes a housing or frame 12, a coil 14, a pole member 16, a magnet 18 that is arranged around the pole member 16 at one end of the frame 12, an armature 20, and a spring 22.

The latching solenoid 10 is moveable between a latched position (FIG. 1) and a rest position (FIG. 2) in response to momentary energization of the coil 14. In the latched position, the armature 20 is held in engagement with the pole member 16 by magnetic attraction of the armature 20 to the magnet 18. While in the latched position, the spring 22 is compressed and exerts a biasing force on the armature 20 in a direction away from the magnet 18. The biasing force of the spring 22 is not, however, sufficient to overcome the magnetic attraction of the armature 20 to the magnet 18. Energization of the coil 14 by supplying electricity of a first polarity to the coil 14 causes the coil 14 to cancel the magnetic attraction of the magnet 18, and the force applied to the armature 20 by the spring 22 causes the armature to move to the rest position. The armature 20 remains in the rest position once the coil 14 is de-energized, because the armature 20 has now moved away from the magnet 18 by a distance sufficient to cause the force of the magnetic attraction applied to the armature 20 by the magnet 18 to diminish such that it is overcome by the biasing force applied to the armature 20 by the spring 22. Energization of the coil 14 by supplying electricity of a second polarity to the coil 14 causes the coil 14 to add to the magnetic attraction of the magnet 18, thereby overcoming the force applied to the armature 20 by the spring 22 such that the armature 20 returns to the latched position.

The latching solenoid 10 is an example solenoid configuration that can be utilized as a basis for implementing the devices described herein. There any many different latching solenoid designs that can be utilized instead of the latching solenoid 10 shown in FIGS. 1-2 that are also operable to move an armature between a latched position and a rest position upon supply of electrical power to a coil without the armature moving in response to de-energization of the coil. Furthermore, although the armature 20 of the latching solenoid 10 moves linearly (i.e. translates along an axis), it should be noted that other solenoid configurations result in different types of motion, and such designs can also be utilized as a basis for implementing the devices described herein. For example, the devices described herein could be implemented using rotary latching solenoids in which the armature rotates on an axis in response to supply of electrical power without the armature moving in response to de-energization of the coil.

Figure 3:
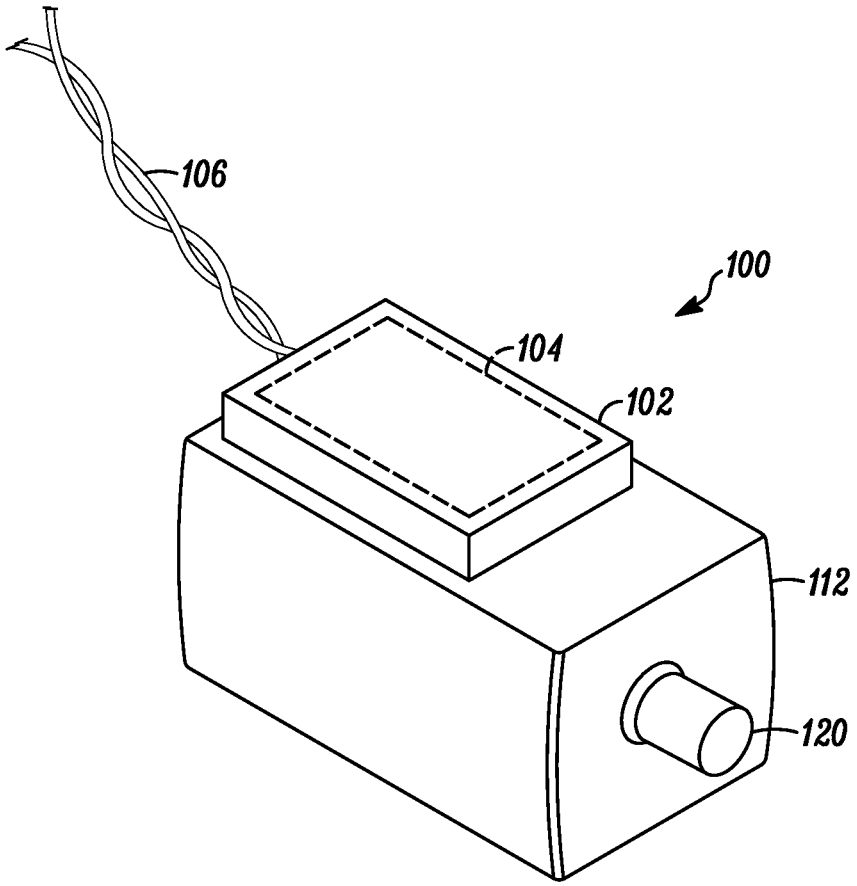
FIG. 3 is a perspective viewing showing a bus configured latching solenoid according to a first example.
Figure 4:
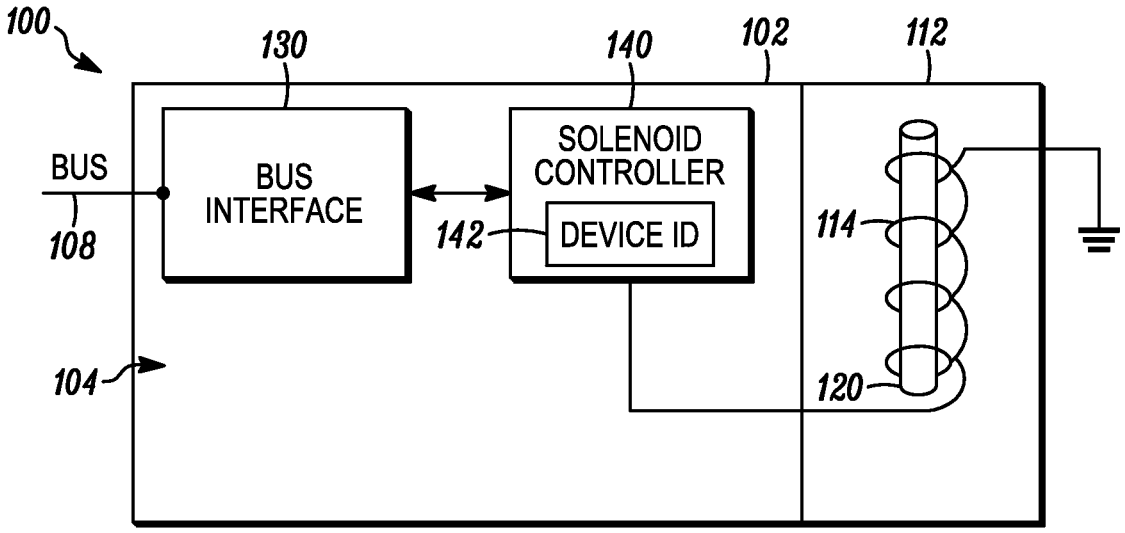
FIG. 4 is a block diagram of the bus configured latching solenoid according to the first example.

FIGS. 3-4 show a latching solenoid 100 that includes a controller housing 102 having control electronics 104 disposed therein that are operable to receive messages from a vehicle bus 108 and output control signals that cause energization of the coil of the latching solenoid 100. The latching solenoid 100 includes conventional components such as those described with respect to FIGS. 1-2, including a frame 112 and an armature 120 that moves between a latched position and a rest position in response to momentary energization of a coil 114 without moving in response to de-energization of the coil 114.

The controller housing 102 is connected to the frame 112. In the illustrated example, the controller housing 102 is positioned on an exterior side surface of the frame 112. The controller housing 102 could be located elsewhere, such as on an end surface of the frame 112 or could be integral with the frame 112. A controller housing 110 can be provided with electromagnetic shielding in order to prevent malfunction of the control electronics 104 as a result of electromagnetic interference resulting from energization of the coil 114 of the latching solenoid 100. A cable 106 has one or more electrical conductors, and extends out of the controller housing 102 for connecting the control electronics 104 to the vehicle bus 108.

The control electronics 104 include a bus interface 130 and a solenoid controller 140. In some implementations, the bus interface 130 and the solenoid controller 140 are separate devices. In other implementations, a single hardware device includes the functionality of the bus interface 130 and the solenoid controller 140.

The bus interface 130 is connected to the vehicle bus 108 and to the solenoid controller 140. The bus interface 130 can include the physical connection to the vehicle bus 108 and optionally a bus interface chip, which is a standard hardware component that is configured to operate with a certain type of vehicle bus to facilitate receipt and transmission of messages.

The solenoid controller 140 is operable to output control signals that cause energization of the coil in response to the messages that are received from the vehicle bus 108, for example, via the bus interface 130. The solenoid controller 140 can be a hardware component that includes, for example, one or more processors and one or more memory devices, wherein the one or more processors are operable to execute instructions that are stored by the one or more memory devices.

The solenoid controller 140 is operable to store a device identifier value 142. In operation, the solenoid controller 140 may receive a large number of messages from the vehicle bus 108 via the bus interface 130, since all devices connected to the vehicle bus 108 will receive all messages transmitted on the vehicle bus 108. The device identifier value 142 is utilized by the solenoid controller 140 to identify messages that are intended for the latching solenoid 100. This allows the latching solenoid 100 to be independently addressed by other devices on the vehicle bus 108. Accordingly, the device identifier value 142 can be any type of information by which the solenoid controller 140 can determine whether a particular message is intended for it. In one implementation, the device identifier value 142 is an alphanumeric value. The device identifier value 142 can be a unique value (i.e. no two devices on the same bus have the same device identifier value). In some implementations, however, it may be permissible to utilize the same value for the device identifier value 142 for multiple devices, provided that this will cause the devices to always respond uniformly to a single message.

Typically, a message that is received by the solenoid controller 140 from the vehicle bus 108 will include a device identifier and a command. The device identifier has a value that identifies a specific component or set of like components on the vehicle bus 108. Upon receiving a message from the vehicle bus 108, the solenoid controller first determines whether the device identifier in the message matches the device identifier value 142 that is stored by the solenoid controller 140. If the device identifier in the message matches the device identifier value 142, the solenoid controller 140 processes the command in the message. If the device identifier in the message does not match the device identifier value 142, the solenoid controller 140 ignores the command in the message. In a typical usage case, at least some of the commands that are received by the controller will include a device identifier that matches the device identifier value 142, and thus cause the solenoid controller 140 to output the control signals in response to the messages.

The command is an instruction that is interpretable by the solenoid controller 140. For example, the solenoid controller 140 can be provided with instructions, stored in memory associated with the solenoid controller 140, that define operations to be performed in response to specific commands. For example, a first command that is received by the solenoid controller 140 can correspond to the latched position of the armature 120, and a second command that is received by the solenoid controller can correspond to the rest position of the armature 120. In response to the first command, the solenoid controller outputs a control signal that causes momentary energization of the coil 114 with electrical power of a first polarity, and in response to the second command, the solenoid controller outputs a control signal that causes momentary energization of the coil 114 with electrical power of a second polarity, opposite of the first polarity. In the illustrated example, the solenoid controller is connected directly to the coil 114, and the control signals that are output by the solenoid controller 140 are used to energize the coil. In this example, the solenoid controller 140 can be powered solely by the vehicle bus 108 and the coil is energized by the control signals from the solenoid controller 140. Thus, the vehicle bus 108 serves as the sole source of electrical power for energizing the coil 114.

In the description above, the device identifier and the command are separate values. It should be understood, however, that the device identifier can be combined with a command. A command is considered to include an implicit device identifier if two like devices would not respond similarly to the same command. In an example where a message having a separate device identifier and command are received by multiple latching solenoids 100, each having a different device identifier value 142, the command to move to or remain in the latched position (e.g. a code, value or string that indicates the function to be performed) can be the same for all of the latching solenoids 100 but will only be processed by the latching solenoid 100 with respect to which the device identifier in the message matches the device identifier value 142. In contrast, with respect to a message in which the command and the device identifier of the message are combined, the device identifier is an explicit part of the command. In this example, multiple latching solenoids 100 need not have explicit device identifier values 142, but instead would not all respond to the same command. Thus, for example, the command to move to or remain in the latched position could be different for each of the solenoids.

Figure 5:
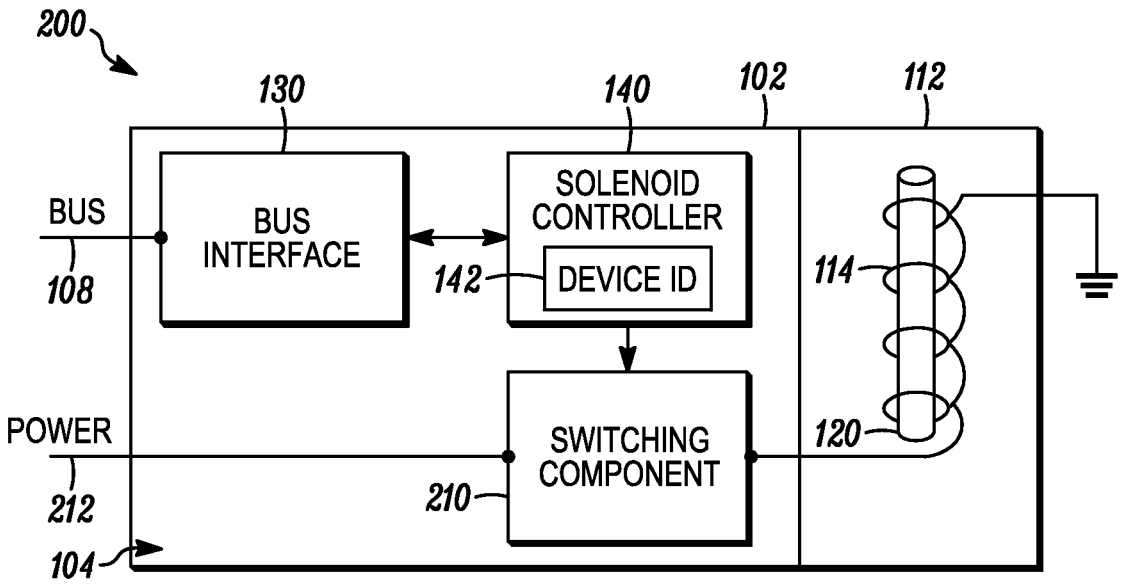
FIG. 5 is a block diagram of a bus configured latching solenoid according to a second example.

FIG. 5 shows a latching solenoid 200. The latching solenoid 200 is similar to the latching solenoid 100. The description made with respect to FIGS. 3-4 applies to the latching solenoid 200 except as otherwise stated herein, and like numbered parts function as previously described.

In the latching solenoid 200, the solenoid controller 140 is not directly connected to the coil 114, but instead is connected to a switching component 210 that receives the control signals from the solenoid controller and is operable to energize the coil 114 in response to the control signals. Various well-known electrical components and combinations of electrical components can be utilized by the switching component to selectively supply electrical power to the coil 114 in response to the control signals, including transistors and relays.

The switching component 210 is electrically connected to a power supply 212 and receives electrical power from the power supply 212. The power supply 212 is an external power supply and can be associated with a vehicle, such as an electrical power system of the vehicle that provides continuous direct current electrical power. Thus, the solenoid controller 140 of the latching solenoid 200 causes energization of the coil 114 by sending the control signals to the switching component 210, and the switching component 210 supplies electrical power to the coil 114 in response to the control signals using the electrical power received from the power supply 212 for energizing the coil. By supplying electrical power to the coil 114 from the power supply 212 via the switching component 210, the latching solenoid 200 can be utilized, for example, in situations where the electrical power supplied via the vehicle bus 108 is not sufficient to energize the coil 114 to an extent sufficient to cause movement of the armature 120 between the latched and unlatched positions.

Figure 6:
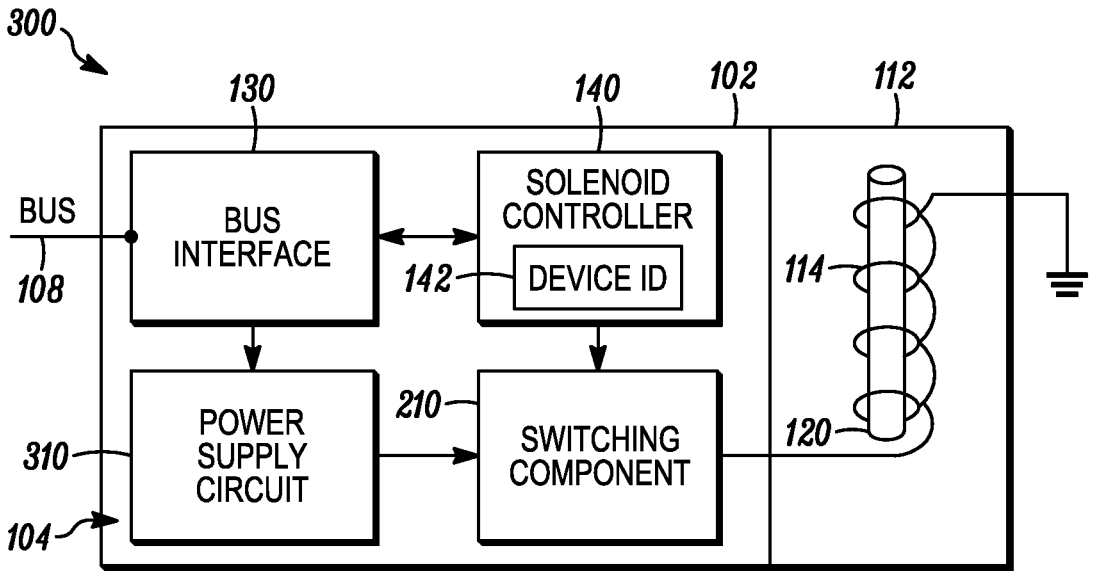
FIG. 6 is a block diagram of a bus configured latching solenoid according to a third example.

FIG. 6 shows a latching solenoid 300. The latching solenoid 300 is similar to the latching solenoid 200. The description made with respect to FIGS. 3-5 applies to the latching solenoid 200 except as otherwise stated herein, and like numbered parts function as previously described.

In the latching solenoid 300, the switching component 210 is not connected to the power supply 212. Instead, the latching solenoid 300 is powered solely by the vehicle bus 108, with power from the vehicle bus 108 being used to energize the coil 114.

The latching solenoid 300 includes a power supply circuit 310 that receives and stores electrical power from the vehicle bus 108 and is connected to the switching component 210 such that electrical power is received at the switching component 210 from the power supply circuit 310 for supplying electrical power to the coil 114 in response to the control signals from the solenoid controller 140.

In the illustrated example, the power supply circuit is connected to the vehicle bus 108 and receives electrical power from it indirectly, via a connection of the power supply circuit 310 to the bus interface 130. As one alternative, the power supply circuit 310 could receive electrical power from the vehicle bus 108 via any other component, such as the solenoid controller 140. As another alternative, the power supply circuit 310 could receive electrical power directly from the vehicle bus 108 by an electrical connection to the vehicle bus 108 that is separate from the connection of the bus interface 130 to the vehicle bus 108.

The power supply circuit 310 is operable to receive and store electrical power from the vehicle bus 108 in order to allow the latching solenoid 300 to be utilized in conjunction with buses that are not compatible with the electrical power requirements of the latching solenoid 300. As one example, the power supply circuit 310 can supply electrical power to the coil 114 via the switching component 210 at a higher voltage than the electrical power supplied by the vehicle bus 108. As another example, the power supply circuit 310 can supply electrical power to the coil 114 via the switching component 210 at a higher current than the electrical power supplied by the vehicle bus 108. In some implementations the power supply circuit 310 includes one or more power storage elements such as a capacitor or a rechargeable battery. In other implementations the power supply circuit 310 includes a voltage booster circuit or a current booster circuit.

Figure 7:
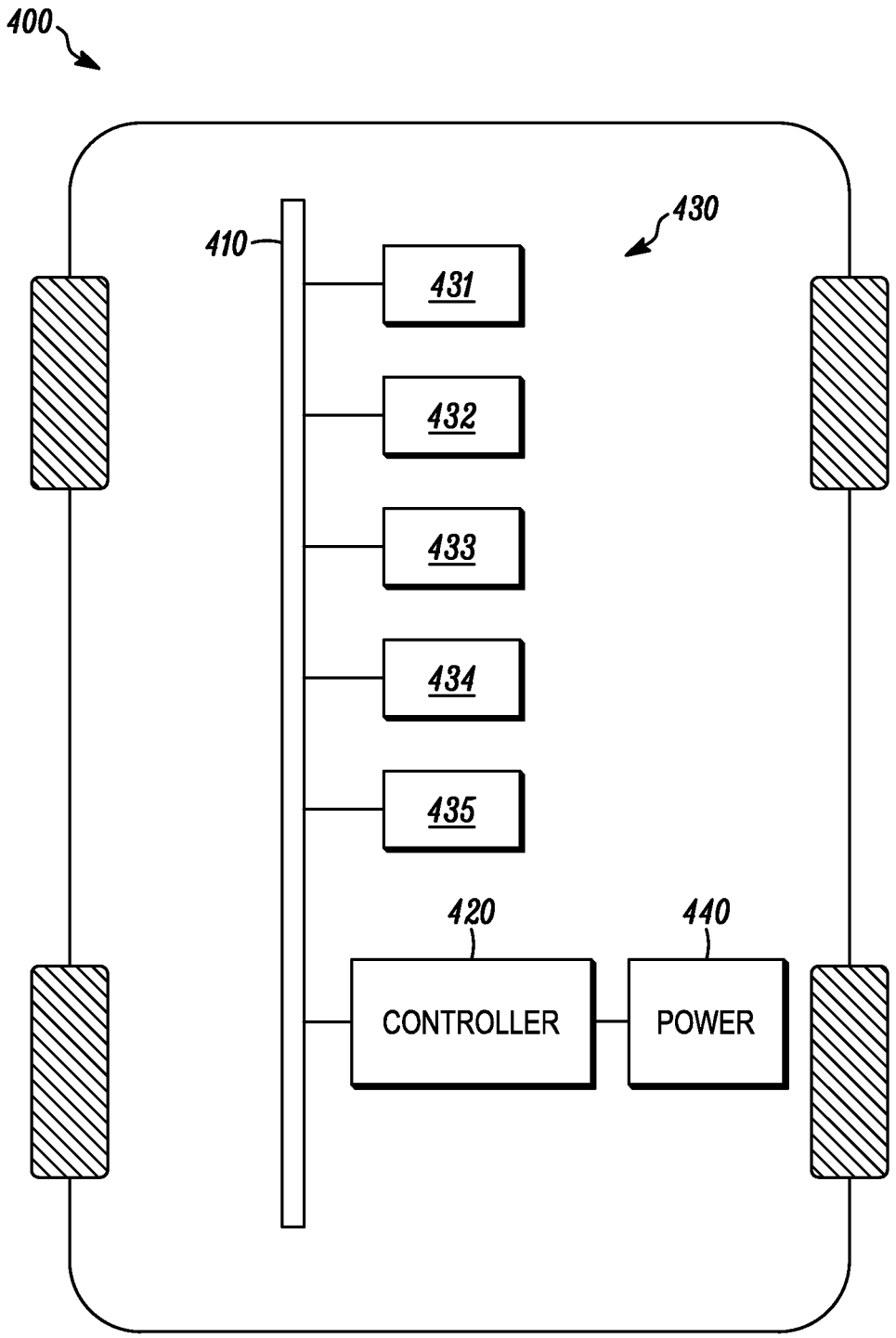
FIG. 7 is a block diagram showing a vehicle having a vehicle bus that is connected to a plurality of bus configured solenoids.

FIG. 7 shows a vehicle 400 that includes a vehicle bus 410. The vehicle bus 410 is a communications bus that is connected to various components of the vehicle 400 and allows those components to transmit and receive messages using the vehicle bus 410. In the illustrated example, the vehicle includes a controller such as a central control unit 420 and a solenoid bank 430.

The central control unit 420 is a conventional device including, for example, a processor and a memory. The memory stores instructions that cause the processor to transmit messages via the vehicle bus 410, where the messages include commands that cause one or more of the solenoids to move between at least a rest position and a latched position. In the illustrated example, the central control unit 420 receives electrical power directly from power supply associated with the vehicle, such as a power supply 440. As an alternative, the power supply 440 could be connected to the vehicle bus 410 either directly or via another bus-connected component, and the central control unit 420 could receive electrical power from the vehicle bus 410.

The solenoid bank 430 includes a plurality of bus configured latching solenoids, such as a first solenoid 431, a second solenoid 432, a third solenoid 433, a fourth solenoid 434, and a fifth solenoid 435. As used herein, "bus configured" refers to a device that is operable to receive and operate in response to messages that are transmitted via a communications bus. The solenoids 431-435 of the solenoid bank 430 can be any of the latching solenoid 100, the latching solenoid 200, or the latching solenoid 300.

In operation, the central control unit 420 transmits a message using the vehicle bus 410. The message includes a command and a device identifier, where the device identifier is one of an explicit value that is contained in the message separate from the command or an implicit part of the command. All of the devices that are connected to the vehicle bus 410 receive the message that is transmitted by the central control unit 420. Each of the solenoids 431-435 of the solenoid bank 430 receives the message and, using its respective solenoid controller, determines whether the message is intended for it by comparing the explicit or implicit device identifier to its own device identifier value. With respect to one or more of the solenoids 431-435 that determine that the message is determined for it, the respective solenoid processes the command. For example, if the command indicates that the respective solenoid is to move to or remain in the rest position and the respective solenoid is currently in the latched position, the solenoid controller of the respective solenoid outputs a control signal that energizes the coil of the respective solenoid with electrical power of a polarity appropriate to cause the armature to move to the rest position.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A latching solenoid comprising:

a coil;

an armature, wherein the armature moves between a latch position and a rest position in response to momentary energization of the coil without moving in response to de-energization of the coil;

a solenoid controller that is operable to receive messages from a vehicle bus and output control signals that cause energization of the coil;

a memory that is associated with the solenoid controller; and a device ID that is stored in the memory, wherein at least some of the messages include the device ID and cause the solenoid controller to output the control signals.

2. The latching solenoid of claim 1, wherein the coil is energized by the control signals from the solenoid controller and the solenoid controller is powered by the vehicle bus.

3. The latching solenoid of claim 1, further comprising:

a switching component that supplies electrical power to the coil in response to the control signals for energization of the coil.

4. The latching solenoid of claim 3, wherein electrical power is received at the switching component from a power supply associated with a vehicle.

5. The latching solenoid of claim 4, further comprising:

a coil;

an armature, wherein the armature moves between a latch position and a rest position in response to momentary energization of the coil without moving in response to de-energization of the coil;

a solenoid controller that is operable to receive messages from a vehicle bus and output control signals that cause energization of the coil;

a switching component that supplies electrical power to the coil in response to the control signals for energization of the coil; and a power supply circuit that receives and stores electrical power from the vehicle bus, wherein the electrical power is received at the switching component from the power supply circuit.

6. The latching solenoid of claim 1, further comprising:

a magnet to hold the armature in the latch position; and a spring that exerts a force on the armature in a direction away from the magnet.

7. A vehicle, comprising:

a vehicle bus;

a vehicle power supply that supplies electrical power to the vehicle bus;

a central control unit connected to the vehicle bus for transmitting messages via the vehicle bus; and a plurality of separately addressable latching solenoids connected to the vehicle bus for receiving the messages from the central control unit, each of the latching solenoids having:

a coil, an armature, wherein the armature moves between a latch position and a rest position in response to momentary energization of the coil without moving in response to de-energization of the coil, and a solenoid controller that is operable to output control signals that cause energization of the coil in response to the messages from the vehicle bus.

8. The vehicle of claim 7, further comprising:

a memory that is associated with the solenoid controller; and a device ID that is stored in the memory, wherein at least some of the messages include the device ID and cause the solenoid controller to output the control signals.

9. The vehicle of claim 7, wherein the coil is energized by the control signals from the solenoid controller and the solenoid controller is powered by the vehicle bus.

10. The vehicle of claim 7, further comprising:

a switching component that supplies electrical power to the coil in response to the control signals for energization of the coil.

11. The vehicle of claim 10, wherein electrical power is received at the switching component from a power supply associated with a vehicle.

12. The vehicle of claim 10, further comprising:

a power supply circuit that receives and stores electrical power from the vehicle bus, wherein electrical power is received at the switching component from the power supply circuit.

13. The vehicle of claim 11, further comprising:

a magnet to hold the armature in the latch position; and a spring that exerts a force on the armature in a direction away from the magnet.

14. The vehicle of claim 7, wherein the messages from the central control unit include commands that cause one or more of the solenoids from the plurality of separately addressable latching solenoids to move between the rest position and the latched position.

15. The latching solenoid of claim 5, further comprising:

a memory that is associated with the solenoid controller; and a device ID that is stored in the memory, wherein at least some of the messages include the device ID and cause the solenoid controller to output the control signals.

16. The latching solenoid of claim 5, wherein the coil is energized by the control signals from the solenoid controller and the solenoid controller is powered by the vehicle bus.

17. The latching solenoid of claim 5, further comprising:

a magnet to hold the armature in the latch position; and a spring that exerts a force on the armature in a direction away from the magnet.

18. The latching solenoid of claim 5, further comprising:

a bus interface connected to the vehicle bus to facilitate receipt of the messages by the solenoid controller from the vehicle bus and output of the control signals to energize the coil.

19. The latching solenoid of claim 18, wherein the bus interface and the solenoid controller are configured as separate devices.

20. The latching solenoid of claim 19, wherein the bus interface is connected to the solenoid controller.

* * * * *